US006301906B1

(12) United States Patent
Thiel et al.

(10) Patent No.: US 6,301,906 B1
(45) Date of Patent: Oct. 16, 2001

(54) METHOD OF ADJUSTING TWO SHIELD ELEMENTS ARRANGED ABOVE A METAL STRIP AND A DEVICE FOR EFFECTING THE METHOD

(75) Inventors: Hermann Thiel, Siegen; Jürgen Seidel, Kreuztal; Peter Holterhoff, Olpe; Marcus Cramer, Attendorn, all of (DE)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 09/587,482

(22) Filed: Jun. 5, 2000

(30) Foreign Application Priority Data

Jun. 4, 1999 (DE) ..... 199 25 535

(51) Int. Cl.[7] ..... F25D 17/02; B21B 27/06
(52) U.S. Cl. ..... 62/64; 62/374; 72/201
(58) Field of Search ..... 62/64, 374; 72/201; 239/514; 34/231

(56) References Cited

U.S. PATENT DOCUMENTS 5,526,652 * 6/1996 Mantovan ..... 62/64

FOREIGN PATENT DOCUMENTS

3230866 * 4/1983 (DE) .

* cited by examiner

*Primary Examiner*—William Wayner
(74) *Attorney, Agent, or Firm*—Sidley Austin Brown & Wood, LLP

(57) ABSTRACT

A method of adjusting a position of two shield elements for a liquid cooling medium and arranged above a metal strip having a strip plane and a strip central plane extending transverse to the strip plane and intersecting the same along the strip central axis, with the two shield elements being located opposite each other with respect to the strip central plane and having each an adjustable component identical to the adjustable component of another of the two shield elements and adjustable transverse to the strip central plane, and with the method including providing an adjusting element connectable with the two shield elements for adjusting the same, and adjusting the adjusting element in the strip central plane; and a device for effecting the method.

17 Claims, 2 Drawing Sheets

METHOD OF ADJUSTING TWO SHIELD ELEMENTS ARRANGED ABOVE A METAL STRIP AND A DEVICE FOR EFFECTING THE METHOD

BACKGROUND OF THE INVENTION

1. Field of the Invention

The present invention relates to a method of adjusting, with an adjusting element, a position of two shield elements for a liquid cooling medium and arranged above a metal strip having a strip plane, a strip central axis, and a strip central plane extending transverse to the strip plane and intersecting the same along the strip central axis with, the two shield elements being located opposite each other with respect to the strip central plane and having each an adjustable component identical to the adjustable component of another of the two shield elements and adjustable transverse to the strip central plane, and a device for effecting the method.

2. Description of the Prior Act

An above-described method and a device for effecting the same are disclosed in German Patent No. 3,230,866. Generally, in accordance with the state of the art, the adjustment of shield elements in effected by a motor which is connected with the shield elements for adjusting same by shafts, gear sets, and threaded rods.

The devices for effecting the adjustment of the shield elements are understandably complicated, are malfunction-prone and expensive.

Accordingly, an object of the present invention is to provide a method of and a device for adjustment of shield elements which would insure an easier and more reliable adjustment of the shield elements.

Another object of the present invention is to provide a shield element adjusting device that can be cost-effectively produce.

SUMMARY OF THE INVENTION

These and other objects of the present invention, which will become apparent hereinafter, are achieved by providing shield element adjusting method and apparatus or device according to which an adjusting element is arranged in the central plane of the strip and is adjustable therein.

The provision of the adjusting element in the strip central plane provides for an adjustment of the shield elements with the adjusting element without the use of complicated mechanisms. In particular, it become possible to simply connect the adjusting element with the shield elements by connecting rods.

The adjustment of the shield elements can be effected only transverse to the strip central plane. This can be carried out by displacing the shield elements in guide rails extending parallel to the strip plane.

However, it is also possible to effect an adjustment of the shield elements parallel to the strip central plane. This is carried out by pivoting the shield elements about respective pivot points.

A particularly effective adjustment of the shield elements takes place when the two shield elements are connected with the two pivot points, respectively, by support arms each of which is provided with a hinge point located between the pivot point and the shield element and connected with adjusting element by a connecting rod. The adjustment of the shield elements is effected in accordance with a lever principle.

When the relationship between adjustment of the adjusting element and the adjustment of the shield elements is not linear, as is the case when the adjustment of the shield elements takes place transverse to the strip central plane, the adjustment of the adjusting element is effected by a control element in accordance with a required adjustment of the shield element which is preset in the control element. Thereby, a precise adjustment of the shield elements is effected despite the non-linear relationship between the adjustment of the adjusting element and the adjustment of the shield elements.

The adjustment of the shield elements can be effected in a particular simple manner and with great precision when a plurality of adjustment pairs of required adjustment of the shield element/adjustment of the adjusting element is preset in the control element, and the control element carries out an interpolation between the adjustment pairs for determining the necessary adjustment of the adjusting element in order to obtain a required adjustment of the shield elements.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
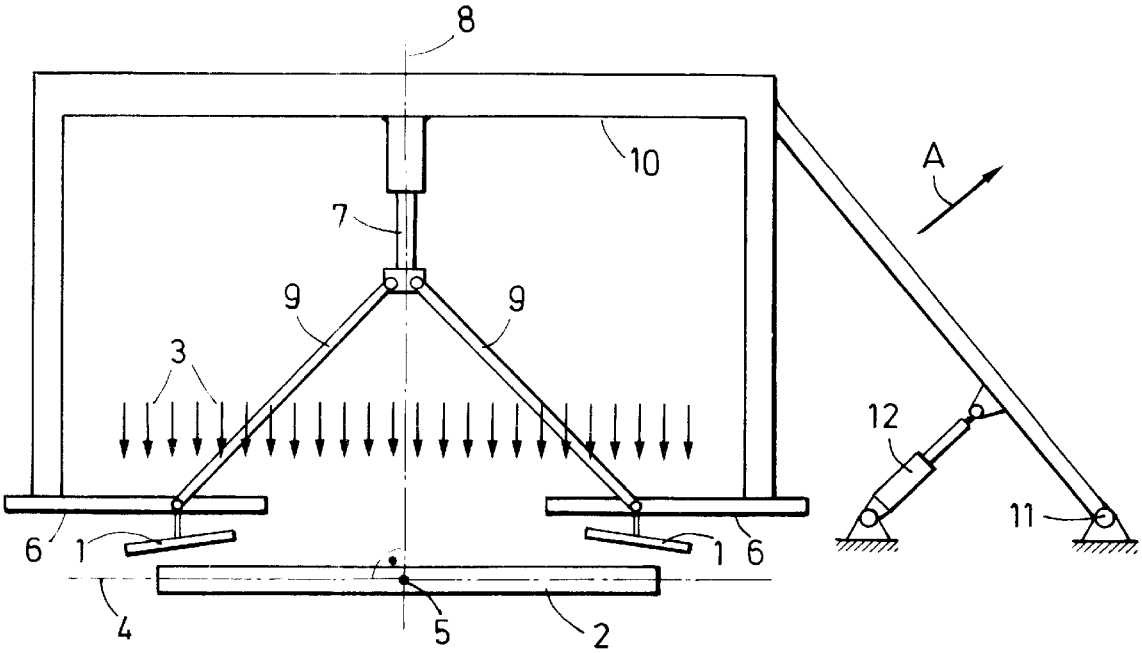
FIG. 1 a schematic side view of a first embodiment of an adjusting device according to the present invention.

As shown in FIG. 1, two shield elements 1 are arranged above a metal strip 2. The shield elements 1 shield a liquid fluid medium 3, as a rule, water, from the metal strip 2 located beneath the shield elements. As a rule, the metal strip 2 is a steel strip. It can also be formed of any other metal, e.g., copper, aluminum. The metal strip 2 has a strip plane 4 and is transported, during operation parallel to the central axis 5 of the strip.

As shown in FIG. 1, the adjusting device includes guide rails 6 in which the shield elements 1 are displaceable. The guide rails 6 extend parallel to the strip plane 4.

The shield elements 1 are adjusted with an adjusting element 7. The adjusting element 7 is arranged in a strip central plane 8. The strip central plane 8 extends transverse to the strip plane 4 and interests the strip plane 4 along the strip central axis 5. The adjusting element 7 is connected with the shield elements 1 by connection rods 9.

The adjustment of the adjusting elements 7 provides, due to the rigid connection of the adjusting element 7 with the shield elements 1, for the adjustment of the shield elements 1. The guidance of the shield elements in the guide rails 6 insure the adjustment of the shield elements 1 only in a plane transverse to the strip central plane 8. Because of the symmetrical arrangement of the shield elements 1 relative to the strip central plane 8, the shield elements 1 have the same opposite adjustment components in the direction transverse to the strip central plane 8. In another words, with respect to the strip central plane 8, the shield elements are moved by the same amount toward each other or away from each other.

The guide rails 6 and the adjusting element 7 are arranged in a frame 10. The frame 10 is pivotally supported in a base 11. The entire adjusting device is pivoted away from the metal strip 2 by a pivoting unit 12, in a direction shown by arrow A.

Both the adjusting element 7 and the pivoting unit 12 are formed as hydraulic cylinder units. However, other drives such as, e.g., electric or hydraulic motors can be used.

Figure 2:
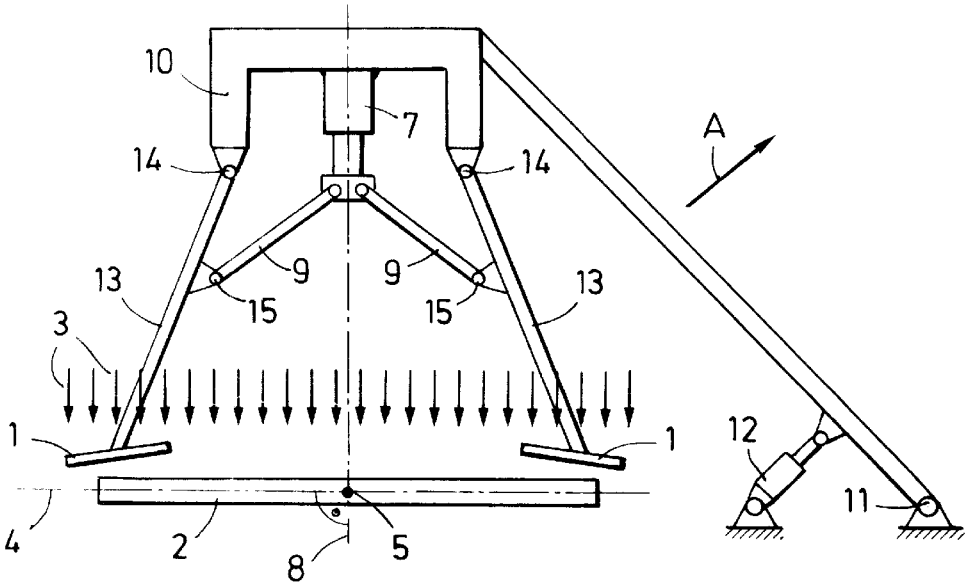
FIG. 2 a schematic view of a second embodiment of an adjusting device according to the present invention.

FIG. 2 shows a modified embodiment of the adjusting device. In the embodiment shown in FIG. 2, the same component are designated with the same reference numerals. The embodiment of FIG. 2 differs from that of FIG. 1 in that the shield elements 1 are connected with pivot points 14 by support arms 13. The connection rods 9 are pivotally connected with the support arms 13 at hinge points 15. The hinge points 15 are located between the pivot points 14 and the shield elements 1. In this embodiment, the shield elements 1 are pivoted with respect to the pivot points 14 upon the adjustment of the adjusting element 7. Thus, the adjustment of the shield elements 1 includes adjustment components transverse to the strip central plane 8 and adjustment components parallel to the strip central plane 8.

Figure 3:
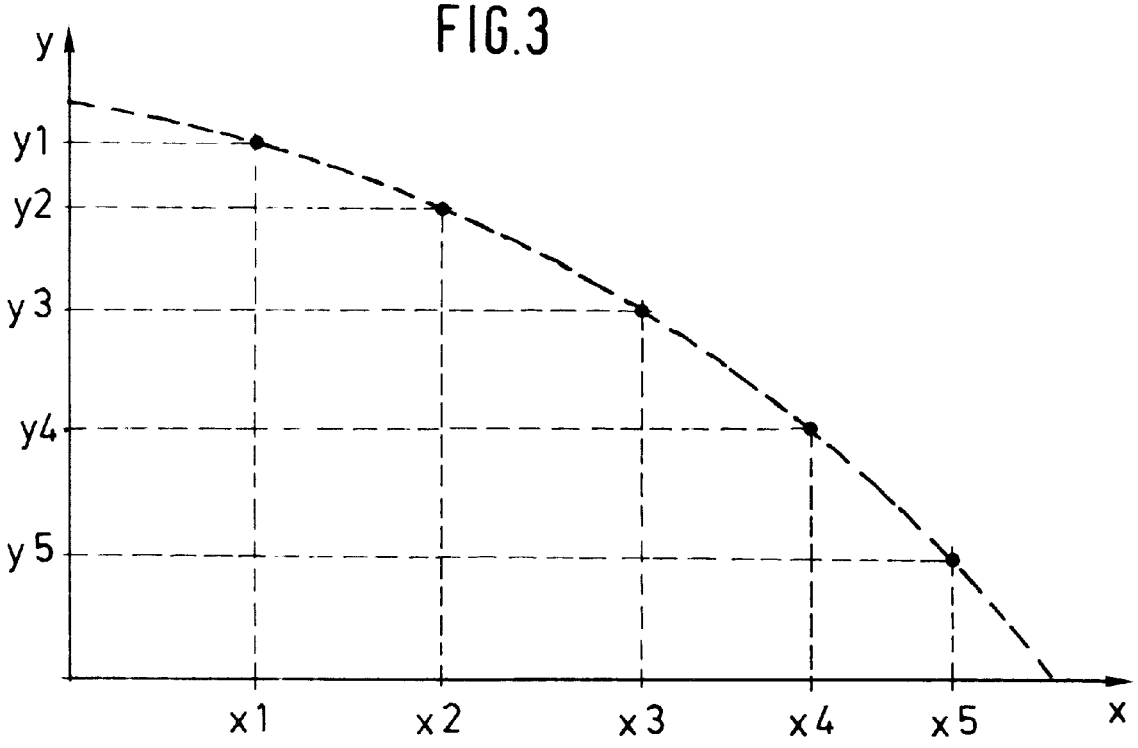
FIG. 3 an adjusting diagram.

Because of conversion of an adjustment of the adjusting element 7 into an adjustment of the shield elements 1 in the direction transverse to the strip central plane 8, the relationship between the adjustment of the adjusting element 7 and the adjustment of the shield elements 1 is not linear. This is shown, e.g., in FIG. 3. FIG. 3 shows a plurality of adjustment pairs xn/yn. Xn corresponds to the adjustment of the shield elements 1, and yn corresponds to the corresponding adjustment of the adjusting element 7.

Figure 4:
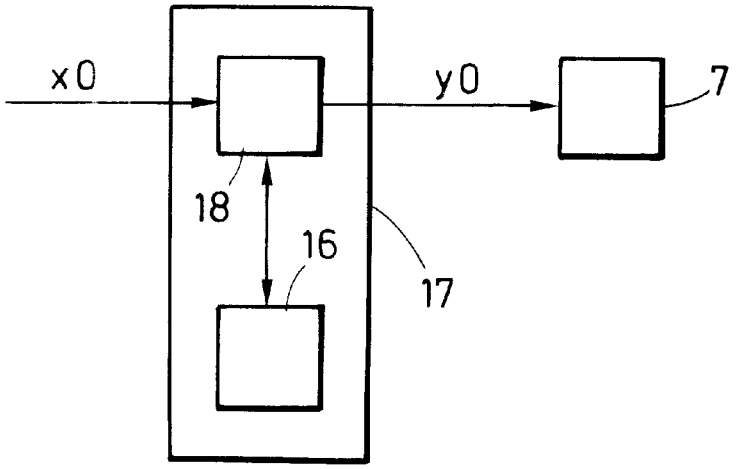
FIG. 4 a schematic view of an adjusting element together with a control element.

The adjustments xn of the shield elements 1 and the corresponding adjustments yn of the adjusting element 7 form together adjustment pairs xn/yn. According to FIG. 4, the adjustment pairs xn/yn are stored in a memory of a control element 17 and are preset in the control element 17. When an adjustment xo is preset in the control element 17, the control element is able to output a corresponding adjustment yo of the adjusting element 7. To this end, the control element 17 includes an interpolator 18 that, based on the adjustment pairs xn/yn, by interpolation, is able to output the corresponding adjustment yo of the adjusting element 7. Dependent on a desized precision, either linear or higher interpolation can be carried out.

The adjustment pairs xn/yn are preferably linear with respect to the adjustment xn of the shield elements 1. However, this is not a compulsory requirement.

The adjusting process according to the present invention and the corresponding adjusting device for effecting the same insure a simple, reliable, and cost-effective operation of the adjusting device. In particular, no numerous operational conversions of the device are necessary.

The adjustment xo of the shield element 1 is, as a rule, preset for a metal strip 2 having a predetermined strip width. It is, however, easier than with a conventional technique change the adjustment xo during operation when the adjusting process and device according to the present invention are used. In particular, e.g., a larger region of the strip can be covered at the strip beginning and the strip end than at the strip central portion.

The adjusting process and the corresponding adjusting device are particularly applicable at so-called edge masking in a cooling line for a rolled product or between two rolling stands of a multi-stand rolling train.

Accordingly, through the present invention was shown and described with reference to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A method of adjusting a position of two shield elements for a liquid cooling medium and arranged above a metal strip having a strip plane, a strip central axis, and a strip central plane extending transverse to the strip plane and intersecting the same along the strip central axis, the two shield elements being located opposite each other with respect to the strip central plane and having each an adjustable component identical to the adjustable component of another of the two shield elements and adjustable transverse to the strip central plane, the method comprising the steps of providing an adjusting element connectable with the two shield elements for adjusting the same; and adjusting the adjusting element in the strip central plane.

2. A method as set forth in claim 1, comprising the step of connecting the adjusting element with the shield elements by respective connection rods.

3. A method as set forth in claim 1, wherein adjustment of the shield elements is effected only transverse to the strip central plane.

4. A method as set forth in claim 3, further comprising the step of providing guide rails arranged parallel to the strip plane for guiding the shield elements.

5. A method as set forth in claim 1, wherein the shield elements have each an adjustable component adjustable parallel to the strip central plane.

6. A method as set forth in claim 5, further comprising the step of providing two pivot points about which the two shield elements can be pivoted.

7. A method as set forth in claim 6, comprising the steps of connecting the two shield elements with the two pivot points, respectively, by support arms; providing, on each support arm, a hinge point located between the pivot point and the respective shield element; and connecting the adjusting element with the hinge points by respective connection rods.

8. A method as set forth in claim 1, further comprising the step of providing a control element for effecting a predetermined adjustment the adjusting element in accordance with a required adjustment of the shield elements preset in the control element to provide for the required adjustment of the shield elements.

9. A method as set forth in claim 8, comprising the step of presetting, in the control element, a plurality of adjustment pairs of required adjustment of the shield element adjustment of the adjusting element, and carrying out an interpolation between the adjustment pairs for determining a required adjustment of the adjusting element.

10. A device for adjusting a position of two shield elements for a liquid cooling medium and arranged above a metal strip having a strip plane, a strip central axis, and a strip central plane extending transverse to the strip plane and intersecting the same along the strip central axis, the two shield elements being located opposite each other with respect to the strip central plane and having each an adjustable component identical to the adjustable component of another of the two shield elements and adjustable transverse to the strip central plane, the device comprising an adjusting element arranged in the strip central plane; and means for connecting the adjusting element with the shield elements.

11. A device as set forth in claim 10, wherein the connecting means comprises two connecting rods connecting the adjusting element with respective shield elements.

12. A device as set forth in claim 10, wherein the adjusting elements comprises means for adjusting the adjusting element only transverse to the strip central plane.

13. A device as set forth in claim 12, further comprising rail means arranged parallel to the strip plane for guiding the shield elements.

14. A device as set forth in claim 10, wherein the shield elements have each an adjusting component parallel to the strip central plane, and wherein the device comprises two pivot points about which the two shield elements pivot.

15. A device as set froth in claim 14, further comprising two support arms for connecting the two support arms for connecting the two shield elements with the two pivot points and each having a hinge point located between the pivot point and the shield element; and two connection rods for connecting the adjusting element with the hinge points on the two support arms, respectively.

16. A device as set forth in claim 10, comprising a control element for effecting a predetermined adjustment of the adjusting element in accordance with a required adjustment of the shield elements preset in the control element to provide for the required adjustment of the shield elements.

17. A device as set forth in claim 16, wherein the control element comprises a memory for storing of adjustment pairs of required adjustment of the shield element/adjustment of the adjusting element, and an interpolator for carrying out an interpolation between the adjustment pairs for determining a required adjustment of the adjusting element.

* * * * *